US005435447A

United States Patent [19]

Weatherford et al.

[11] Patent Number: 5,435,447

[45] Date of Patent: Jul. 25, 1995

[54] PRODUCT HOLDING AND DISPLAYING MEMBER

[75] Inventors: Javier V. Weatherford, Canton; William H. Valls, Harwinton, both of Conn.

[73] Assignee: Acme United Corporation, Fairfield, Conn.

[21] Appl. No.: 199,852

[22] Filed: Feb. 22, 1994

[51] Int. Cl.[6] ..... A45C 11/26

[52] U.S. Cl. ..... 206/349; 206/461; 206/493

[58] Field of Search ..... 206/349, 461, 470, 471, 206/493

[56] References Cited

U.S. PATENT DOCUMENTS

| | | | |
|---|---|---|---|
| 4,165,805 | 8/1979 | Fethke et al. | 206/461 |
| 4,179,029 | 12/1979 | Fethke et al. | 206/349 |
| 4,423,811 | 1/1984 | Knapp | 206/470 |
| 4,714,159 | 12/1987 | Linden | 206/349 |
| 4,872,551 | 10/1989 | Theros | 206/470 |
| 4,899,877 | 2/1990 | Kiernan | 206/470 |
| 5,279,417 | 1/1994 | Seaton | 206/470 |

FOREIGN PATENT DOCUMENTS

| | | | |
|---|---|---|---|
| 2215298 | 9/1989 | United Kingdom | 206/461 |

*Primary Examiner*—David T. Fidei
*Attorney, Agent, or Firm*—Melvin I. Stoltz

[57] ABSTRACT

A unique clamshell-type holding and displaying member is attained which is capable of securely retaining an arcuately pivotable product therein, with the product being able to be tested prior to purchase, by incorporating product a holding and locking member which peripherally surrounds and securely lockingly engages one arm of the product. In the preferred embodiment, the holding and displaying member is constructed for securing scissors or shear-type products and the product holding and locking member is constructed to peripherally envelope one finger loop forming handle thereof, thereby assuring secure, retained interengagement of the product in the holding and displaying member.

19 Claims, 9 Drawing Sheets

PRODUCT HOLDING AND DISPLAYING MEMBER

TECHNICAL FIELD

This invention relates to product holding and displaying members and, more particularly, to clamshell constructions for such holding and displaying members.

BACKGROUND ART

The use of product holding and displaying members has become increasingly popular in order to enable both secure holding of products to be sold as well as providing the ability of these products to be conveniently displayed for sale. Typically product holding and display members are formed from transparent plastic material to enable consumers to see the product being purchased prior to actually buying the product. Generally, prior art product holding and display members comprise either a blister-pack type design or a clamshell-type design.

The blister-pack product holding and display members have become very popular due to the lower cost and ease of manufacture. However, the blister-type packages cannot be reused when opened, thereby preventing the consumer from employing the packaging for storage. In this regard, the clamshell product holding and display members have been employed for providing the desired product securement and visual display capabilities, as well as being able to be reused by the consumer as a holding member for the product after use.

Although product holding and display members formed from the clamshell-type construction have become increasingly popular, particularly for more expensive products, due to their reusability, one drawback which has plagued the industry is the inability of the clamshell-type product holding and display member from being successfully employed with products the consumer wishes to test prior to purchase. Although a variety of products fall within this class of goods, the most typical type of product comprises cutting or shearing members, such as scissors, clippers, hedge trimmers, and the like.

Prior art product holding and displaying members have been constructed of the blister-type variety which securely retains shear-type instruments and allow consumers to test the shear-type instrument prior to purchasing. Although effective in enabling consumers to test the product prior to purchase, these prior art packages require additional assembly steps to assure secure retention of the product and display of the product in the closed position. In addition, in order to securely retain the product, complete closure of the product is typically unobtainable. As a result, the complete cutting action cannot be tested.

No prior art construction has been attained for enabling such shear-type instrument to be retained in a clamshell-type holding and display member which allows the consumer the ability to test the product prior to purchasing. Due to the construction requirements for clamshell-type product holding members, prior art systems have been incapable of being constructed which will allow such pivotable product member to be retained in a clamshell holder while also being usable or testable prior to purchase.

Therefore, it is a principal object of the present invention to provide a clamshell-type product holding and display member which is capable of securely retaining the product while also enabling the product to be tested by the consumer prior to use.

Another object of the present invention is to provide a product holding and display member having the characteristic features described above which can be employed for securely retaining pivotable cutting or shear-type instruments, such as scissors, clippers, trimmers and the like.

Another object of the present invention is to provide a product holding and display member having the characteristic features described above which enables the shear-type instrument to be pivoted or operated by the consumer prior to use, while also securely retaining the product in a clamshell construction in a manner which assures the retailer that the product cannot be removed from the holding and display member without opening the clamshell construction.

Another object of the present invention is to provide a product holding and display member having the characteristic features described above which enables the shear-type instrument to be assembled with the holding and display member in the closed position, thereby preventing the opening and closing of the shear-type instrument during packaging.

Another object of the present invention is to provide a product holding and display member having the characteristic features described above which enables the shear-type instrument to be completely closed while retained in the holding and display member, thereby providing improved testing of the product.

Other and more specific objects will in part be obvious and will in part appear hereinafter.

SUMMARY OF THE INVENTION

By employing the present invention, the prior art failures have all been overcome and a product holding and display member having a clamshell-type construction is achieved which is capable of securely holding and completely retaining a shear-type or cutting-type product in a manner which enables a consumer to test the operation of the product prior to purchasing. In addition, assembly of the product in the holding and display member is attained quickly and easily.

In the typical construction of shear-type or cutting-type instruments for which the clamshell product holding and display member of the present invention are particularly suited, the products are constructed with two cooperating, pivotally interconnected members each of which comprises a cutting or blade portion and a handle portion. By moving the handle portion about the pivot axis, the cutting portions are able to arcuately pivot into and out of cutting, trimming, or shearing interengagement.

In order to securely retain the product within the clamshell holding and display member of the present invention, while also enabling the product to be tested prior to use, the holding/display member incorporates an enlarged holding zone formed in the area within which the cutting portions of the product are retained. In this way, the cutting portions are provided with sufficient area to arcuately pivot relative to each other, so that the product can be tested.

Furthermore, one of the two handle portions of the two cooperating members is securely retained within the holding/display member, while the other handle is mounted outside of the holding/display member, positioned in cooperating, movable, relationship with a portal zone. In this way, the handle portion mounted outside of the holding/display member is movable by the consumer, enabling the consumer to test the product prior to purchase.

In order to securely retain the pivotable shear or cutting member and assure that the entire member cannot be removed from the holding/display member in an unwanted manner, without opening the holding/display member, handle locking means are formed in the holding/display member to peripherally surround and securely retain the handle member positioned therein. In this way, unwanted removal of the product form the holding/display member is prevented.

In order to provide further assurance that the product is secured within the holding/display member and unwanted removal therefrom is prevented, while also providing the desired arcuate movability or usability of the product prior to purchase, clamshell locking and product holding means are formed in juxtaposed, spaced, cooperating relationship with the retained handle member of the instrument held therein. This construction provides further assurance that the product retained therein cannot be withdrawn, when not desired.

In addition, the preferred construction enables the handle members to be completely closed, while securely retained in the holding and display member. As a result, the complete cutting interaction of the product can be tested. In this way, securement of the desired product in a clamshell product holding and display member is realized and the consumer is able to achieve complete testing or use of the product prior to purchase.

The invention accordingly comprises an article of manufacture possessing the features, properties, and relation of elements which will be exemplified in the article hereinafter described and the scope of the invention will be indicated in the claims.

THE DRAWINGS

For a fuller understanding of the nature and objects of the invention, reference should be had to the following detailed description taken in connection with the accompanying drawings in which.

DETAILED DESCRIPTION

Figure 1:
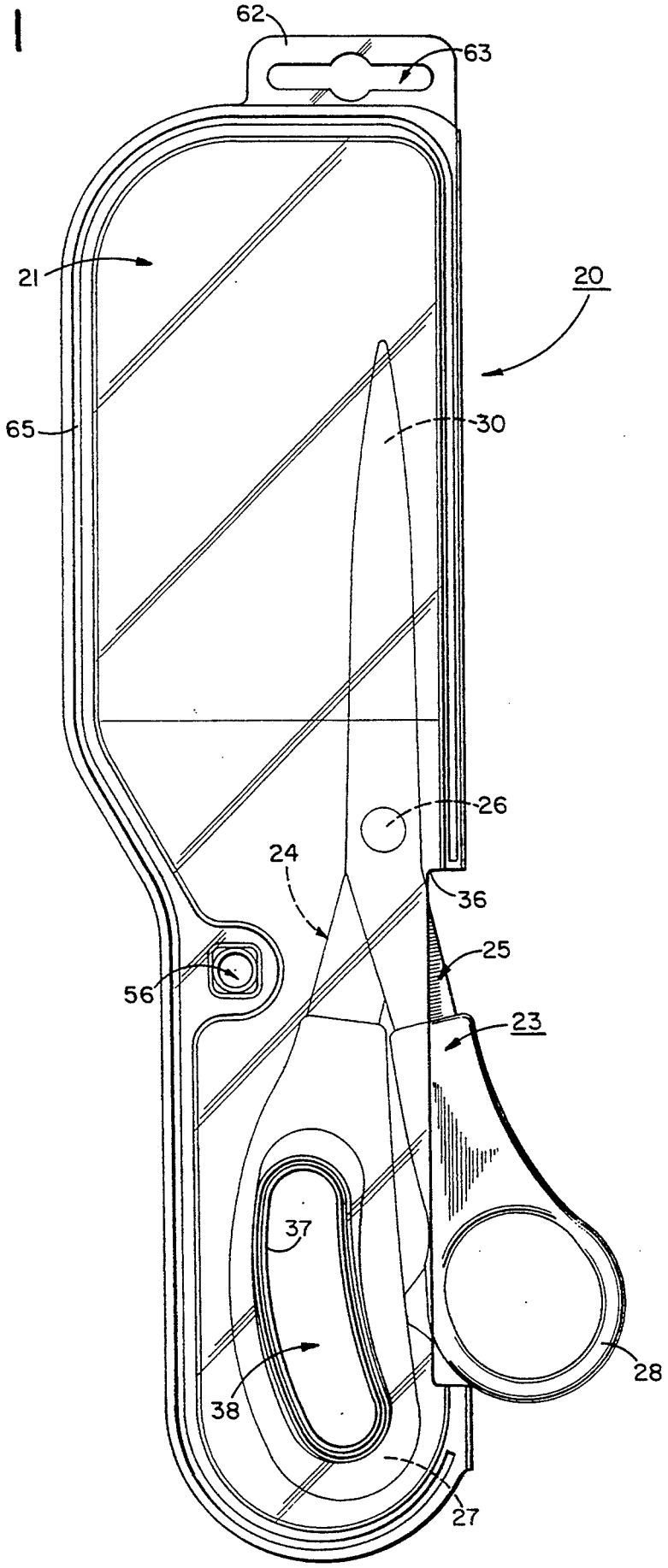
FIG. 1 is a top plan view of the clamshell-type holding and display member of the present invention shown fully assembled with a closed pair of scissors securely retained therein.

By referring to FIGS. 1–12, along with the following detailed disclosure, the construction and operation of the holding/display member of the present invention can best be understood. As is evident from the present disclosure, the holding/display members detailed herein can be employed for a wide variety of products. However, for exemplary purposes only, without intending to be limited thereto, the following drawings detail the present invention in use for securely retaining, holding, and displaying conventional scissors or shears. It is to be understood, however, that the applicability of the present invention is not limited to scissors and/or shears and that other products can be employed with the present invention with equal efficacy.

For purposes of completeness, two alternate scissors sizes are depicted. However, since the construction of the scissors and the holding/display member is substantially identical for each embodiment, the same reference numerals are used throughout. However, where any variations do exist, these variations are discussed in detail.

As shown in FIGS. 1–2 and 7–8, holding/display member 20 of the present invention is depicted as comprising a unitary, integrally formed housing 21 within which a conventional pair of scissors 23 is securely retained. In its preferred embodiment, housing 21 is formed from transparent plastic material and, in accordance with the present invention, securely retains scissors 23 in a manner which enables scissors 23 to be tested by the consumer prior to purchase.

As depicted in FIGS. 1–2 and 7–8, scissors 23 comprise a conventional construction which incorporates two separate and independent arm members 24 and 25, which are pivotally mounted to each other by pivot pin 26. Arm member 24 incorporating a handle portion 27 and a blade portion 29, while arm member 25 incorporates a handle portion 28 and a blade portion 30. With arm members 24 and 25 pivotally mounted to each other by pivot pin 26, handle portions 27 and 28 are arcuately movable about the axis defined by pivot pin 26 in order to enable blade portions 29 and 30 to be pivotally operated in the conventional manner.

As shown in FIGS. 1–2 and 7–8, scissors 23 are securely retained within housing 21 of holding/display member 20 with handle portion 27 securely affixed to housing 21, while handle portion 28 extends outwardly from housing 21 through elongated portal 36. As is more fully detailed below, housing 21 incorporates a handle holding and securing wall 37 which is formed in and peripherally encompasses the elongated finger-receiving zone of handle portion 27 of scissors 23. In this way, scissors 23 are securely retained within housing 21 with handle portion 27 thereof being affixed to housing 21 due to handle holding and securing wall 37.

In its preferred construction, handle holding and securing wall 37 is substantially continuous, peripherally surrounding and enclosing the finger-engaging zone of handle 27. In this way, wall 37 effectively establishes an open zone 38, which the consumer employs as a finger engaging zone for testing scissors 23.

Figure 2:
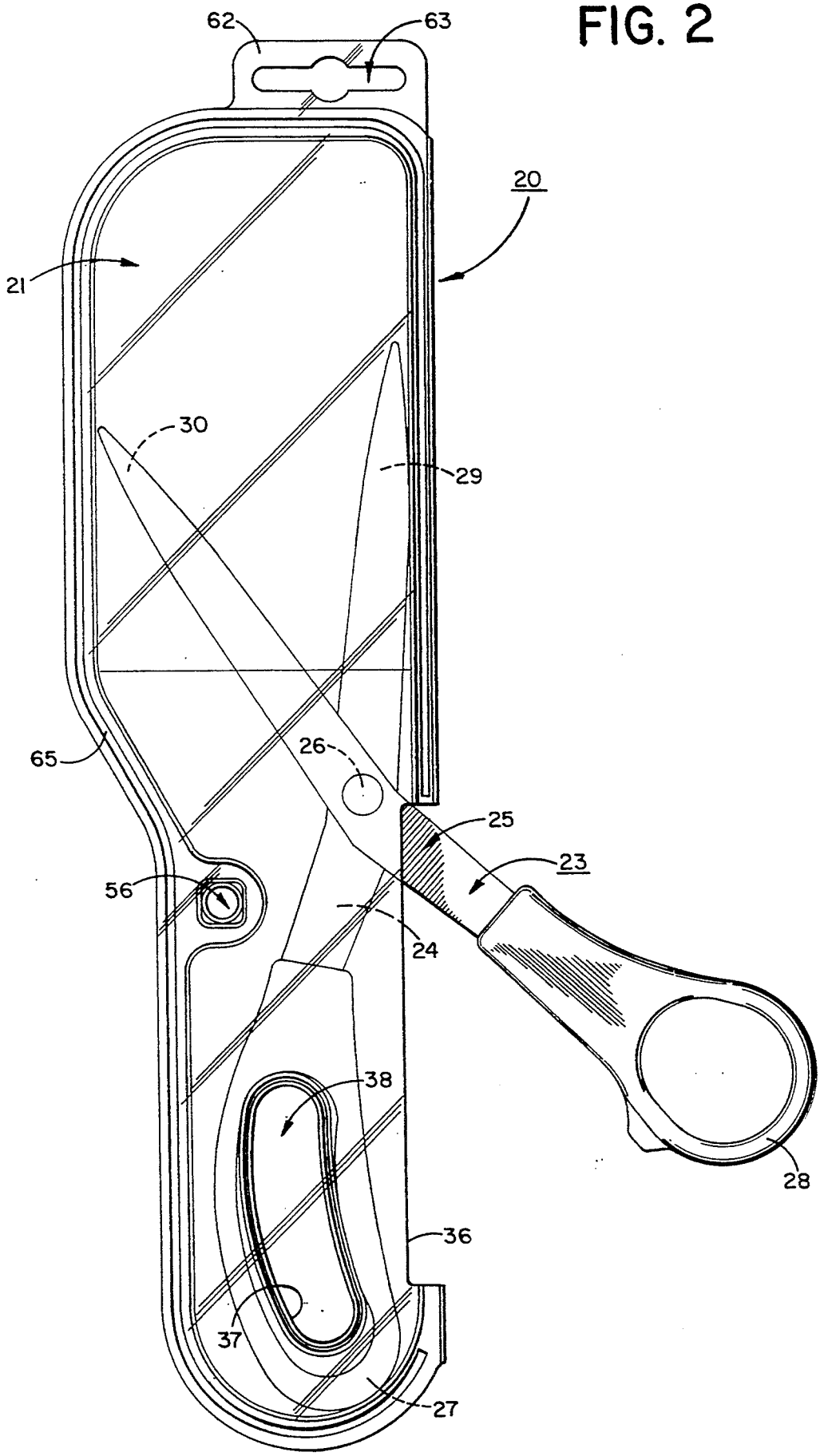
FIG. 2 is a top plan view, similar to FIG. 1, depicting the scissors in their open position.
Figure 3:
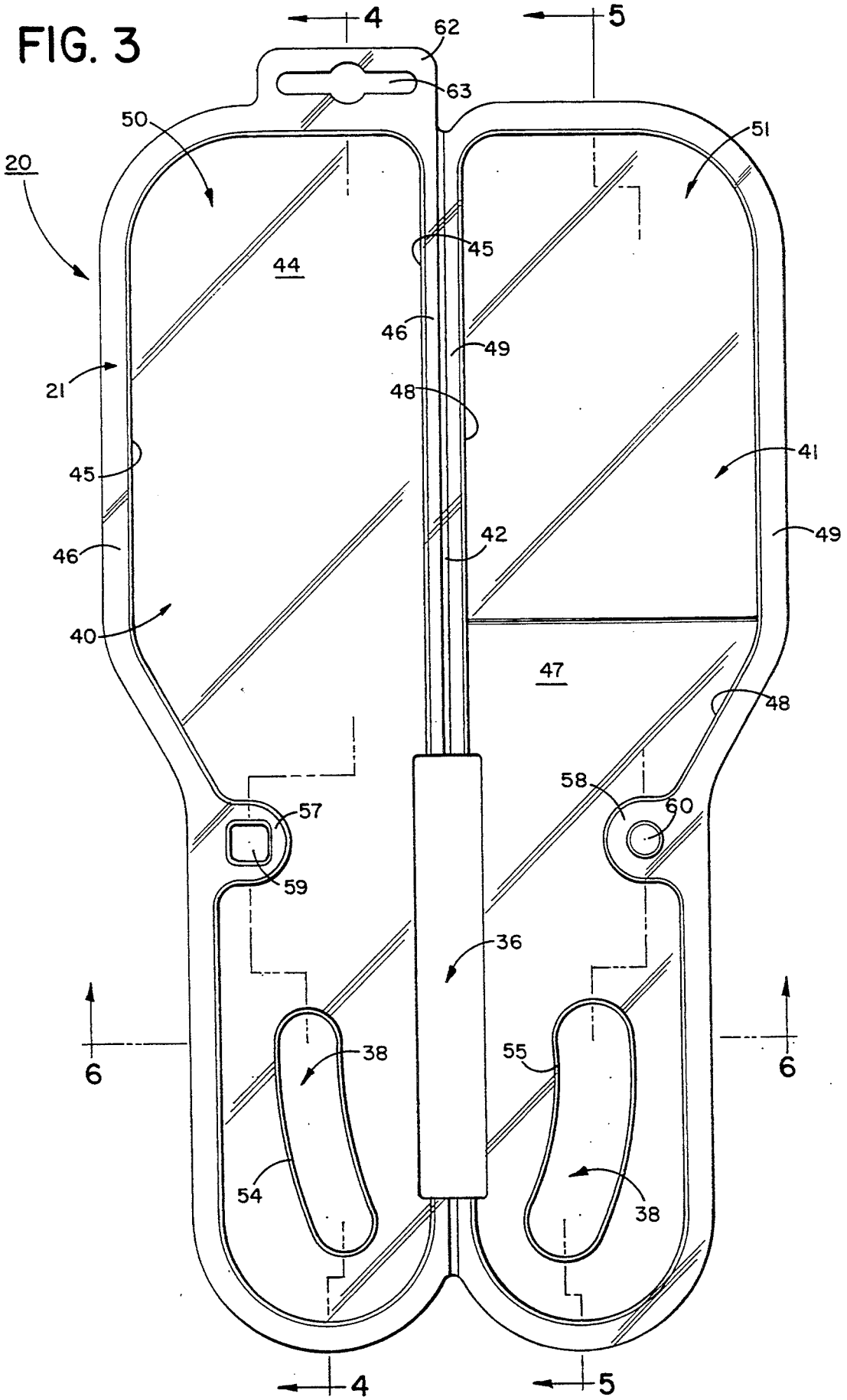
FIG. 3 is a top plan view of the clamshell-type holding/display member of the present invention depicted prior to assembly.
Figure 4:
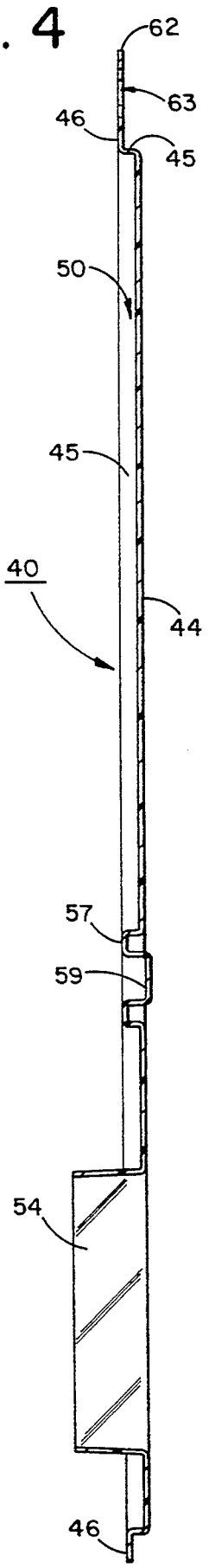
FIG. 4 is a cross-sectional side elevation view of the holding/display member of the present invention taken along line 4—4 of FIG. 3.
Figure 7:
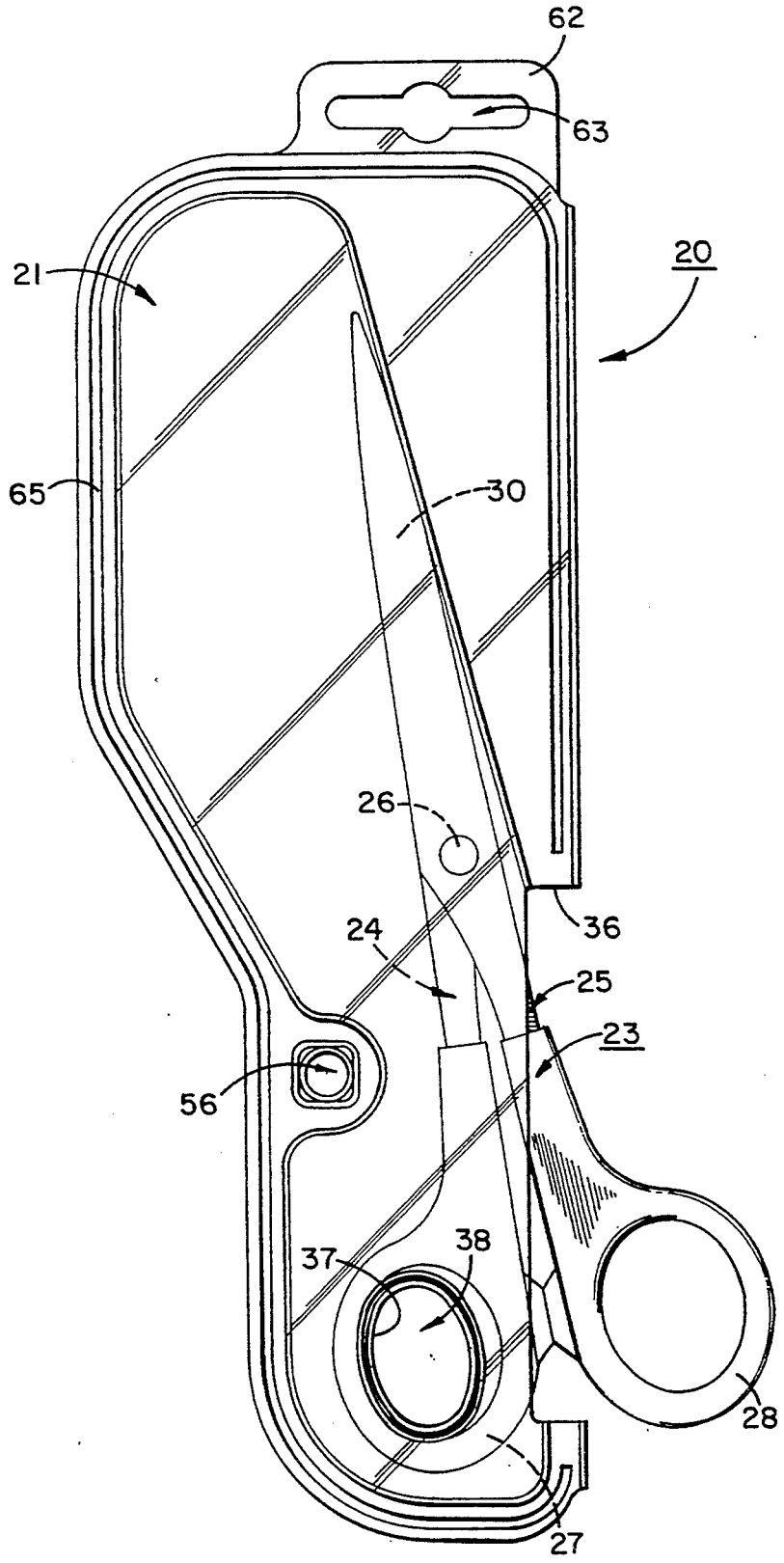
FIG. 7 is a top plan view of an alternate embodiment of the clamshell-type holding/display member of the present invention depicted fully assembled, holding an alternately constructed pair of scissors, shown it its closed position.
Figure 8:
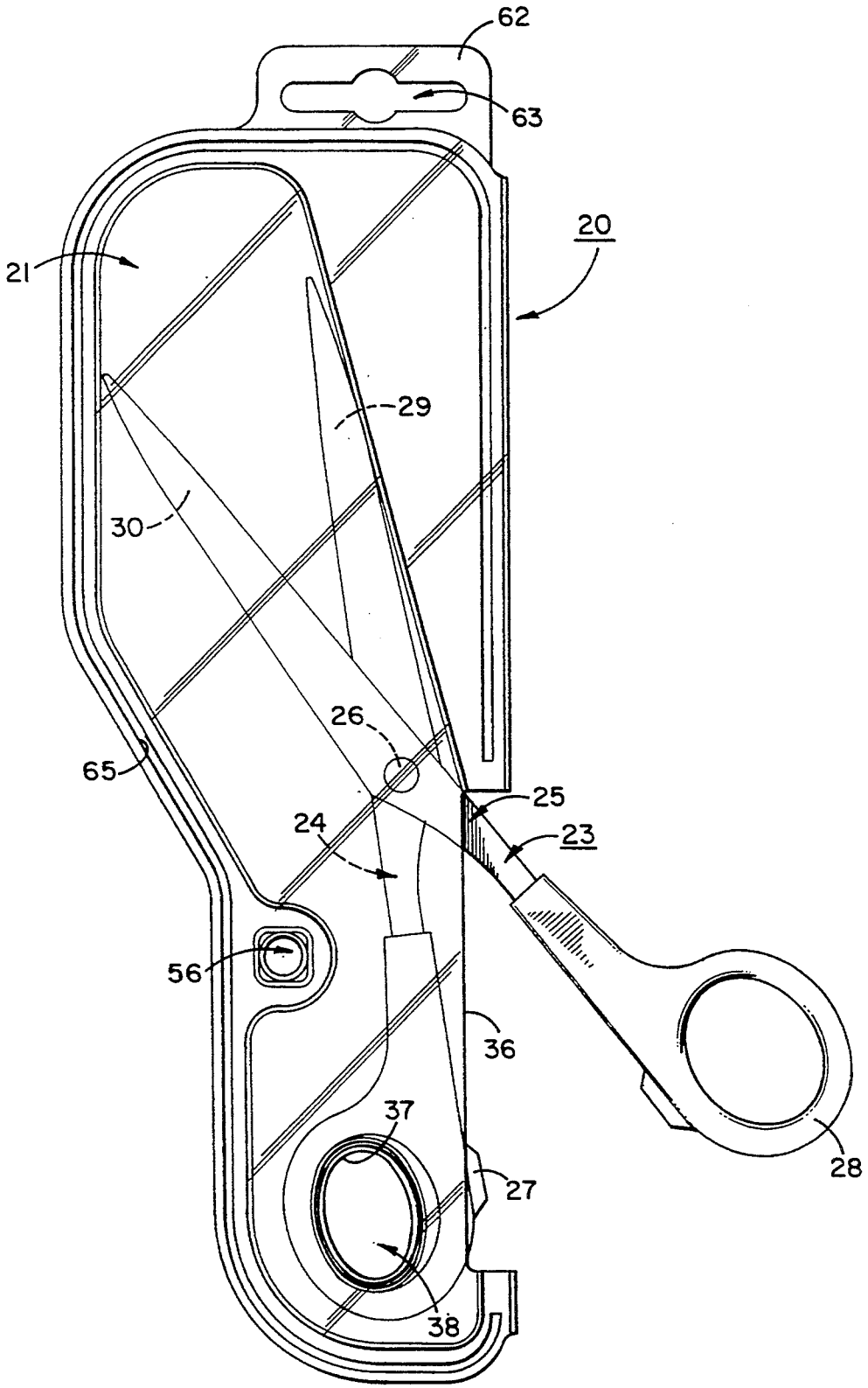
FIG. 8 is a top plan view of the holding/display member of FIG. 7 depicting the scissors in its open position.

As clearly depicted in FIGS. 1–2 and 7–8, holding-/display member 20 of the present invention is constructed in a manner which enables the consumer to easily and conveniently test scissors 23. By employing holding/display member 20, handle portion 28 of scissors 23 is arcuately movable a sufficient distance to cause blade portion 30 to be pivoted out of aligned interengagement with blade portion 29. Then, when desired, handle portion 28 is moved back to its original position, thereby testing the cutting interaction of blade portion 30 with blade portion 29. In FIGS. 2 and 8, the maximum arcuate movement of handle portion 28 and blade portion 30 is depicted, while FIGS. 1 and 7 depict the fully engaged, closed position.

By employing this construction, a consumer is capable of easily and conveniently placing one or more fingers in open zone 38, with the thumb of the user being placed in the receiving zone of handle portion 28. Then, in the normal manner, the consumer is able to repeatedly operate scissors 23 to assure that the contacting interengagement of blade portions 29 and 30 is achieved in the desired manner. All of this testing is easily attained without disturbing or in any way adversely affecting holding/display member 20, as well as without removing scissors 23 from secure, mounted, interengagement with holding/display member 20.

In order to provide the secure, retained mounted engagement of scissors 23 in housing 21 of holding/display member 20 and enable scissors 23 to be arcuately pivoted by the consumer, without adversely affecting holding/display member 20, holding/display member 20 comprises a unique construction. By referring to FIGS. 3–6 and 9–12, along with the following detailed disclosure, the construction details and unique features of the present invention will be apparent.

In its preferred embodiment, holding/display member 20 comprises housing 21 which is formed in a unitary, integral construction which incorporates two interconnected, cooperating panel member 40 and 41. In the preferred construction, panel members 40 and 41 are integrally joined to each other by a single, foldable elongated hinge 42, which interconnects the two panel members along an adjacent edge, creating a "clamshell" construction. Hinge 42 incorporates an enlarged, elongated portal zone 36 formed therein which, as detailed above, enables handle 28 to extend outwardly from housing 21.

In its preferred construction, panel member 40 comprises an enlarged, elongated, substantially flat base 44 which is peripherally surrounded by upstanding wall 45 from which flange 46 extends. As clearly depicted in FIGS. 3 and 9, upstanding wall 45 peripherally surrounds base 44 substantially in its entirety, except for elongated portal 36, with flange 46 extending from wall 45 throughout. This construction establishes interior, scissors holding zone 50.

In a generally similar construction, panel member 41 comprises an enlarged, elongated base 47 with upstanding wall 48 peripherally surrounding base 47 substantially in its entirety, with flange 49 extending from the terminating edge of upstanding wall 48. This construction establishes an interior scissors holding zone 51.

Figure 9:
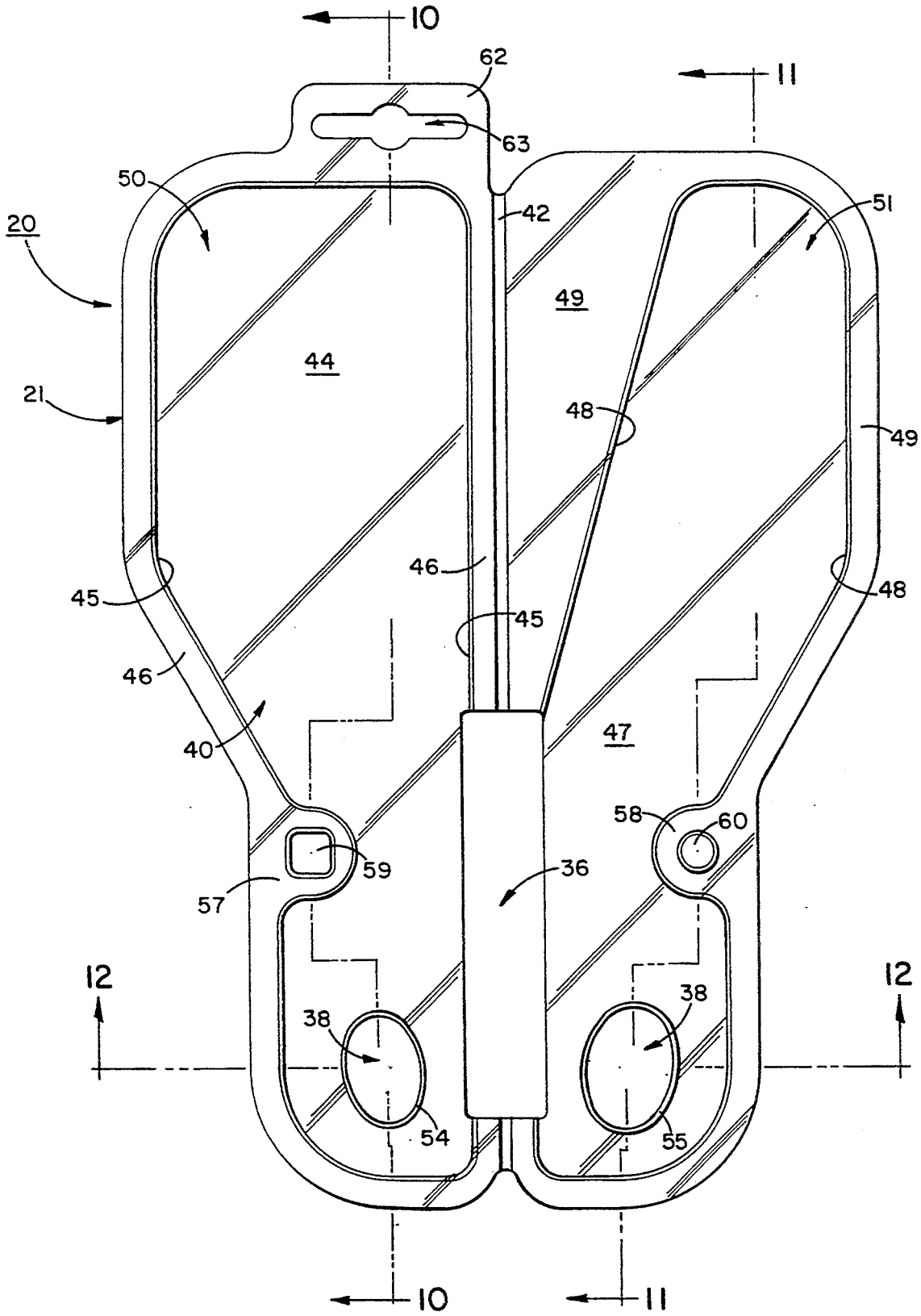
FIG. 9 is a top plan view of the clamshell holding-/display member construction of the present invention depicted prior to assembly.
Figure 10:
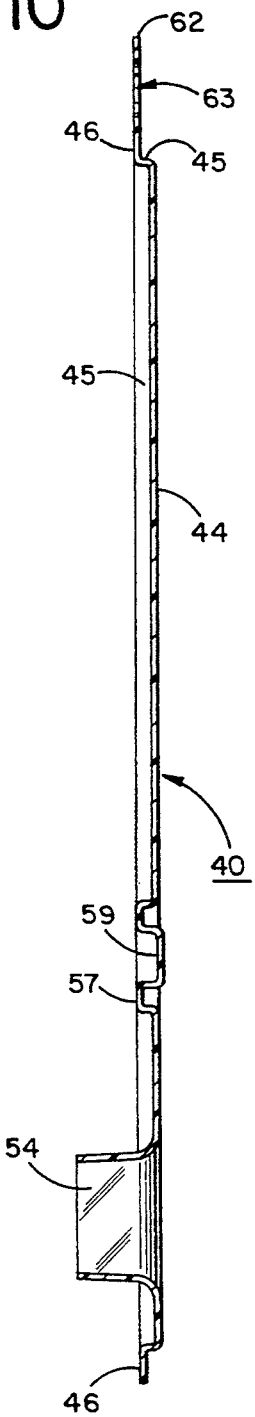
FIG. 10 is a cross-sectional side elevation view of the holding/display member of the present invention taken along line 10—10 of FIG. 9.

In the embodiment shown in FIGS. 7, 8 and 9, holding zone 51 of panel member 41 comprises a smaller area than holding zone 50 with flange 49 comprising an enlarged surface area to assure that both panel members 40 and 41 comprise equivalent overall dimensions. Although the formation of a smaller holding zone 51 is optional, it has been found that the overall size of holding zone 51 preferably comprises a volume substantially equivalent to the volume needed for enabling blade portions 29 and 30 to be arcuately moved for testing. However, substantial additional size is not required. Consequently, in order to enable scissors 23 in this embodiment to be freely tested, while limiting any unwanted movement thereof, holding zone 51 of this embodiment comprises a reduced size.

Figure 5:
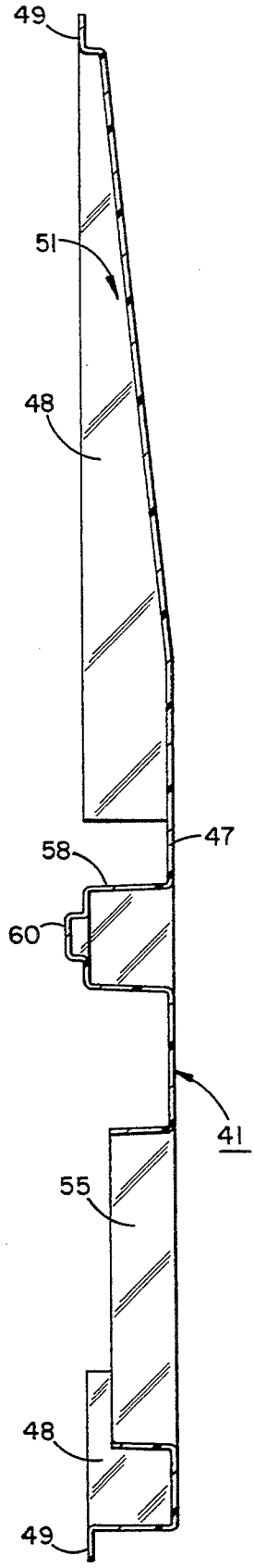
FIG. 5 is a cross-sectional side elevation view of the holding/display member of the present invention taken along line 5—5 of FIG. 3.
Figure 6:
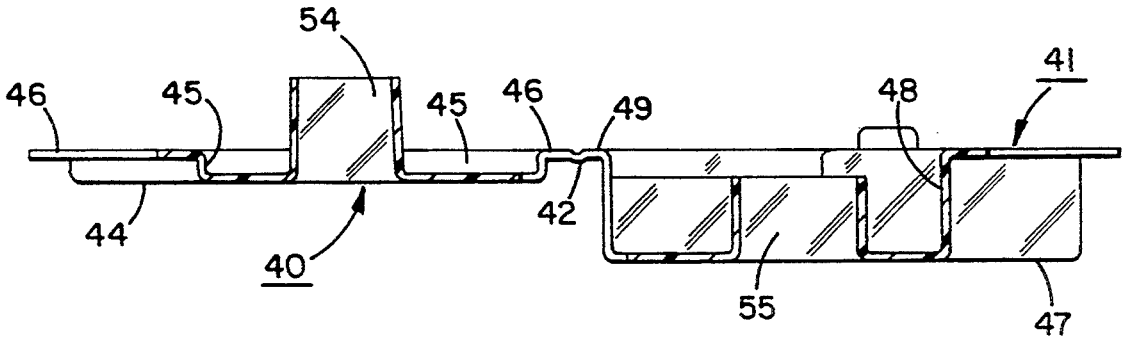
FIG. 6 is a cross-sectional end view of the holding-/display member of the present invention taken along line 6—6 of FIG. 3.
Figure 11:
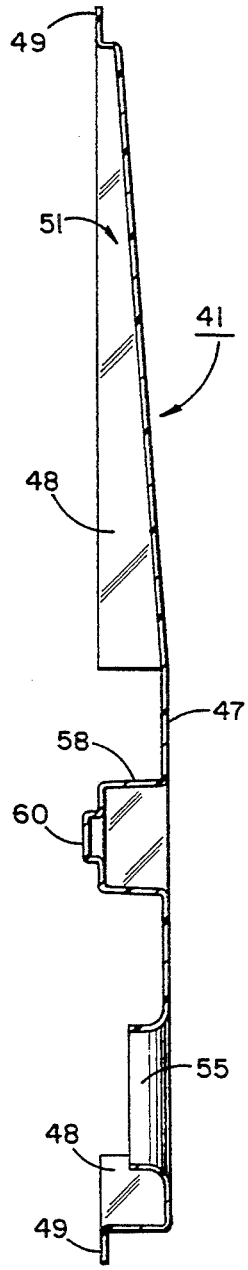
FIG. 11 is a cross-sectional side elevation view of the holding/display member of the present invention taken along line 11—11 of FIG. 9.
Figure 12:
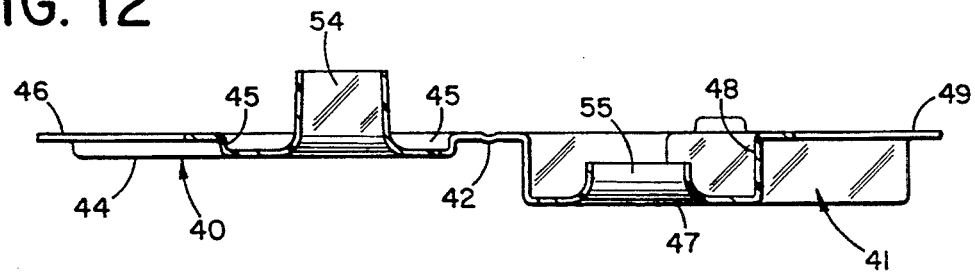
FIG. 12 is a cross-sectional end view of the holding-/display member of the present invention taken along line 12—12 of FIG. 9.

As is more fully detailed below, panel members 40 and 41 are securely affixed to each other in order to retain and display scissors 23 therein. When mounted in secure interengagement, holding zones 50 and 51 cooperate to form the entire scissors holding zone required. In its preferred construction, as best seen in FIGS. 5 and 11, base 47 of panel member 41 is constructed with a portion thereof being ramped or slanted relative to its major portion. This ramped portion is formed in the area in which blade portions 29 and 30 are positioned. Although this construction is optional, it has been found that by incorporating a ramped zone in base 47, in this area, the size of the resulting holding zone conforms to the dimensions of the scissors in the blade portion area. As a result, a more secure, trouble-free assembly is realized.

In order to securely retain scissors 23 in the precisely desired position, panel member 40 incorporates an upstanding handle engaging wall 54 extending upwardly from base 44. In the preferred construction, wall 54 is substantially continuous, peripherally surrounding and defining open zone 38.

In its preferred embodiment, upstanding wall 54 comprises an overall size and shape which substantially conforms to the size and shape of the open, finger-engaging zone formed in handle 27 of scissors 23. By comprising a size and shape conforming to the finger engaging zone of handle 27, upstanding wall 54 is able to be positioned within the finger engaging zone of handle 27, securely retaining and holding handle 27 and scissors 23 in the desired position.

Panel member 41 also incorporates upstanding wall 55 formed therein, extending upwardly from base 47. Upstanding wall 55 is constructed with a size and shape consistent with the size and shape of the finger holding zone formed in handle 27 of scissors 23, with upstanding wall 55 being substantially continuous and also peripherally surrounding and defining open zone 38.

In order to establish clamshell holding/display member 20, panel members 40 and 41 of housing 21 are constructed for cooperating interengagement with each other. In the preferred construction, panel member 41 is constructed for being arcuately pivoted along hinge 42 for placing panel member 41 in overlying, juxtaposed, spaced, cooperating interengaged relationship with panel member 40.

In order to attain the desired cooperating, overlying, juxtaposed, interengagement, walls 54 and 55 are constructed to enable one of the upstanding walls to be inserted within the other upstanding wall. Although either wall may be constructed with a substantially larger included area, the preferred construction, as depicted in the drawings, clearly shows wall 55 having a larger included area in order to enable wall 55 to be easily positioned peripherally surrounding upstanding wall 54 of panel member 40.

As a result, when panel member 41 is arcuately pivoted into overlying, juxtaposed, spaced, relationship with panel member 40, wall 55 peripherally surrounds and cooperatingly engages upstanding wall 54. As detailed above, the cooperating, interconnected, interengagement of upstanding wall 55 with upstanding wall 54 establishes the scissor handle locking member 37 previously discussed.

As is more fully detailed below, this construction enables scissors 23 to be quickly and easily assembled in a securely locked interengagement within holding/display member 20 in a manner which assures speed of assembly, as well as securement and placement of scissors 23 in the precisely desired orientation and configuration. As a result, many of the problems previously encountered by prior art constructions are eliminated.

Another feature preferably incorporated into the holding/display member 20 of the present invention is the incorporation of scissors position-securing means which are located in cooperating relationship with upstanding walls 54 and 55 to assure that scissors 23 are securely maintained in the desired position within holding/display member 20 and are virtually incapable of being removed therefrom, when such removal is unwanted. In the preferred embodiment, position-securing means 56, depicted in FIGS. 1–2 and 7–8, comprise upstanding boss 57 formed in panel member 40 in combination with post 58 formed in panel member 41, as best seen in FIGS. 3–5 and 9–11.

Boss 57 is formed co-extensively with upstanding walls 54 and flange 56, while post 58 is formed co-extensively with wall 48 and flange 49. By incorporating and positioning boss 57 and post 58 in this manner, cooperating interengaging components are formed for assuring that scissors 23 are securely retained in the desired displayed position as well as maintained in that position against unwanted removal.

In completing the construction of boss 57, a cavity 59 is formed therein to provide a recess zone in boss 57. Post 58 incorporates an outwardly extending protrusion 60 formed therein, positioned for mating interengagement with cavity 59 of boss 57.

If desired, panel member 40 incorporate an extension tab 62 formed along flange 46 thereof, which preferably incorporates a receiving hole or slot 63. Although tab 62 and slot 63 are both optional, the preferred embodiment of holding/display member 20 incorporates these components in order to enable holding/display member 20, and scissors 23 contained therein, to be easily mounted on a rack or display for storage and use. In this way, the sale of scissors 23 can be enhanced as well as conveniently stored for consumer access.

By employing the present invention, a fully assembled securely retained scissors holding and display assembly is realized which is able to be produced in an efficient manner completely eliminating many of the prior art difficulties that had previously existed. In addition, the scissors are securely retained in the holding-/display member in a manner which enables the scissors to be tested by the consumer prior to use. This provides further enhanced benefit to the consumer, without increasing costs or expenses.

One of the principal features realized by the holding-/display member 20 of the present invention is the ability to provide a fully assembled, securely positioned scissors 23 within holding/display member 20 in a manner which allows scissors 23 to remain closed throughout the assembly process. One of the principal drawbacks encountered with prior art packaging constructions is the requirement that the scissors must be opened during the manufacturing process, and then closed, in a separate operation.

In the prior art blister pack constructions, the only way in which scissors can be securely retained is to peripherally surround the handle of the scissors on all three sides thereof, substantially in its entirety. Only in this way, is the scissors able to be securely retained on the resulting blister packaging. Once securely mounted in the desired position, an operator is required to close the scissors in order to prevent unwanted shipment of the scissors in the open position.

In the present invention, holding/display member 20 is able to be completely assembled with scissors 23 in the secure, interlocked position therein without requiring scissors 23 to be opened during the assembly process. As a result, production is streamlined and efficiency enhancements are attained.

In order to completely assemble holding/display member 20 with scissors 23, scissors 23, while in the closed position, are merely positioned on base 44 of panel member 40, with the finger-engaging zone of handle portion 27 of scissors 23 peripherally surrounding and enveloping upstanding wall 54. Once in this position, scissors 23 lie within holding zone 50 of panel member 40 with blade portion 29 and 30 extending into the upper portion of holding zone 50.

In positioning scissors 23 on base 44 of panel member 40, handle portion 28 is preferably first inserted through elongated portal 26 prior to placing handle portion 27 about upstanding wall 54. If necessary, panel member 41 may be pivoted about hinge 42 in order to attain the desired position for handle portion 28. Then, once scissors 23 are in the desired secured position, panel member 41 is arcuately pivoted about hinge 42 until panel members 40 and 41 are in overlying, aligned, juxtaposed, spaced, cooperating relationship with each other.

During this arcuate pivoting interengagement, upstanding wall 55 of panel member 41 is advanced into the finger-engaging zone of handle portion 27 with upstanding wall 55 peripherally surrounding and enveloping upstanding wall 54 of base 44. In this way, handle 27 of scissors 23 is securely affixed within housing 21, with the .elongated finger-engaging zone of handle portion 27 securely retained by interengagement with interlocked upstanding walls 54 and 55.

In addition, protrusion 60 of post 58 enters and lockingly engages cavity 59 of boss 57. In this way, panel members 40 and 41 are initially secured to each other, with scissors 23 affixed and retained in the desired displayed position, with scissors 23 being completely closed. As a result, the entire cutting interaction of blade portions 29 and 30 is able to be tested.

In the preferred embodiment, the secure, interlocked, affixed, mounted interengagement of scissors 23 in holding/display member 20 is completed by securing or bonding flanges 49 and 46 together. In this way, unwanted tampering or opening of housing 21 is prevented and secure retention of scissors 23 in holding-/display member 20 is attained. In addition, during the securing or bonding process, protrusion 60 and cavity 59 are also affixed to each other to further assure the desired, secure closure of housing 21.

As clearly depicted in FIGS. 1–2 and 7–8, panel members 40 and 41 are preferably integrally bonded to each other by sonic welding or heat welding of the overlying, abutting flanges thereof. As depicted in these drawings, interlocked elongated, substantially continuous channel 65 is formed, peripherally surrounding the outer perimeter of housing 21 assuring the secure, bonded, locked interengagement of panel members 40 and 41. This securement is further enhanced by bonding protrusion 60 within cavity 59, thereby securely affixing post 58 and boss 57 to each other.

By employing this construction, scissors 23 are securely, lockingly, interengaged within housing 21 of holding/display member 20 in a manner which enables scissors 23 to be completely tested by the consumer prior to purchase, while also assuring retailers that scissors 23 cannot be easily removed from housing 21. In addition to the secure, surrounded locking engagement of handle 27 by wall assembly 37, which also enables the user to insert the user's fingers through aperture 38 for testing scissors 23, holding/display member 20 also incorporates position-securing means 56. Position-securing means 56 cooperate with wall assembly 37 to assure the desired, locked, retained, secure engagement of scissors 23 within housing 21 of holding/display member 20.

As shown in FIGS. 1–5 and 7–11, position-securing means 56 comprises boss 57 and post 58 and is positioned in cooperating alignment with captured handle portion 27 and pivot 26 of scissors 23. In this way, handle 28 of scissors 23 is able to be arcuately pivoted, in order to allow cutting portion 30 to be moved into and out of interengagement with cutting portion 29, while restricting any other movement of scissors 23 which would otherwise enable scissors 23 to be dislodged from its securely retained position. As a result of this construction, secure mounted interengagement of scissors 23 in holding/display member 20 is provided.

By employing this construction, handle portion 27 is retained within holding/display member 20 along only two of its three sides. The third side is substantially unretained and is positioned in juxtaposed, spaced relationship with elongated portal 36. As a result, complete closure of handle portions 27 and 28 is attained.

By securely, lockingly capturing handle portion 27 with wall members 54 and 55, which form wall assembly 37, in combination with position securing means 56, the secure, retained, mounted interengagement of scissors 23 in housing 21 of holding/display member 20 is provided. This construction assures that scissors 23 remains securely mounted in the desired retained and displayed manner with the assurance that unwanted removal from housing 21 is virtually eliminated.

As discussed above, in order to assure secure mounted interengagement of scissors 23 in housing 21 of holding/display member 20, flanges 46 and 49 of panel members 40 and 41 are preferably intimately bonded to each other by conventional sonic or heat welding means. If desired, however, alternate interlocking interengagement of flanges 46 and 49 may be employed, without departing from the scope of the invention so that holding/display member 20 can be used by the consumer as a storage medium for scissors 23 after purchase. In this regard, other locking systems, such as snap closures, or partial bonding can be employed in order to enable housing 21 to be opened, after purchase, without substantially destroying housing 21.

As is apparent from the preceding description, holding/display member 20 of the present invention provides a clamshell packaging assembly which eliminates all of the prior art objections and attains a construction wherein products are securely, lockingly retained in a holding and display member for sale and distribution wherein the product can be completely tested by the consumer prior to use. By employing the present invention, all of the failures of the prior art have been overcome and a highly effective, easily employed unique, holding/display member is realized.

It will thus be seen that the objects set forth above, among those made apparent from the preceding description, are efficiently attained and, since certain changes may be made in the above article without departing from the scope of the present invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Having described our invention, what we claim is new and desire to secure by Letters Patent is:

We claim:

1. A holding and displaying member for use in combination with an arcuately pivotable product having first and second cooperating arm members pivotally mounted to each other with each arm member incorporating an operating portion and a control portion and with at least one of said control portions incorporating a finger engaging zone, said holding and displaying member comprising A. a housing constructed for peripherally surrounding and enclosing a major portion of the arcuately pivotable product and comprising;

a. a first panel member incorporating a substantially continuous wall dimensioned for peripherally surrounding a major portion of the pivotable product for providing cooperating secure retention thereof and defining a holding zone and a product securement zone, and b. a second panel member constructed for cooperating, aligned, spaced, juxtaposed association with the first panel member and constructed for interlocking engagement therewith to form the holding and display member with the product securely retained therein;

B. a portal zone formed in the wall member of the first panel member of the housing and positioned for enabling the control portion of the first arm member of the product to extend outwardly from the housing and be freely movable relative thereto;

C. a product securement zone comprising a. an upstanding flange formed within the enclosed area defined by the wall of the first panel member and dimensioned for cooperating, secure, retaining engagement within the finger engaging zone of the control portion of the second member for cooperatingly, securely engaging the finger-engaging zone of the control portion of the second arm member, and securely locking the control portion within the housing, and b. a substantially continuous upstanding flange formed in the second panel member and constructed for peripherally surrounding and being cooperatingly associated with the upstanding flange of the first panel member and for being in adjacent cooperating association therewith, peripherally surrounding and enveloping the upstanding flange of the first panel member and the finger-engaging zone of the second member of said product, whereby the finger-engaging zone of the control portion of the second member is securely, integrally affixed to the housing, completely captured in secure, retained, interengagement therewith; and D. a holding zone formed in the housing peripherally surrounding and enclosing the operating portions of the first and the second arm members, enabling the operating portion of at least the first arm member to be arcuately pivoted into and out of cooperating engagement with the operation portion of the second arm member;

whereby a holding and displaying member is attained which enables the product to be tested prior to use, while assuring secure, retained, interengagement of the product within the holding and displaying member.

2. The holding and displaying member defined in claim 1, wherein said product is further defined as comprising a scissors-type or shear-type product and the finger engaging zone of the control portions of at least one of said arm members is further defined as incorporating a finger-receiving loop.

3. The holding and displaying member defined in claim 1, wherein the first panel member and the second panel member are further defined as being integrally attached to each other along opposed sides by an integrally formed elongated hinge member, thereby enabling the second panel member to be pivoted about the hinge member from a first position substantially adjacent to the first panel member to a second position in overlying, aligned, juxtaposed engagement with the first panel member.

4. The holding and displaying member defined in claim 3, wherein the portal zone is further defined as being elongated to enable the control portion of the first arm member to contact the control portion of the second arm member when the product is in its closed position.

5. The holding and displaying member defined in claim 3, wherein the first panel member and the second panel member are each further defined as comprising 1. an enlarged base defining the overall size and shape of the panel member,
2. an upstanding wall peripherally surrounding the base and extending therefrom, and
3. an extending lip peripherally surrounding the wall and extending outwardly therefrom.

6. The holding and displaying member defined in claim 5, wherein the extending lip of the first panel member and the extending lip of the second panel member are further defined as being constructed for overlying contacting engagement with each other when the second panel member is in its second position.

7. The holding and displaying member defined in claim 6, wherein the lip of the first panel member and the lip of the second panel member are further defined as being securely affixed to each other, thereby securely retaining the product therein.

8. The holding and displaying member defined in claim 7, wherein said lips of the first and second panel members are further defined as being affixed to each other by one selected from the group consisting of sonic welding and heat sealing.

9. The holding and displaying member defined in claim 5, and further comprising E. position securing means formed in the housing in cooperating association with the upstanding, integrated flanges of the first and second panels for assuring secure, interlocked, retention of the product in the housing.

10. The holding and displaying member defined in claim 9, wherein said securing means is further defined as comprising a. an upstanding boss formed in the first panel member, and b. an upstanding post formed in the second panel member and positioned for cooperating aligned engagement with the boss of the first member.

11. The holding and displaying member defined in claim 10, wherein said post is further defined as comprising a protrusion extending therefrom and said boss is further defined as comprising a cavity constructed for cooperating, receiving, locking engagement of the protrusion, thereby assuring secure engagement therebetween.

12. The holding and displaying member defined in claim 10, wherein said post is further defined as being formed in the wall and lip of the second panel member and said boss is formed in the wall and lip of the first panel member.

13. The holding and displaying member defined in claim 7, wherein said holding zone is further defined as being defined by the walls of the first and second panel members and the juxtaposed, spaced, facing bases of the first and second panel members.

14. The holding and displaying member defined in claim 13, wherein said holding zone is further defined as comprising a size and shape conforming to the size and shape of the product when in its open and closed positions.

15. A holding and displaying member for use in combination with an arcuately pivotable product having first and second cooperating arm members pivotally mounted to each other with each arm member incorporating an operating portion and a control portion and with at least one of said control portions incorporating a finger receiving loop, said holding and displaying member comprising A. a housing constructed for peripherally surrounding and enclosing a major portion of the arcuately pivotable product and comprising a. a first panel member incorporating 1. an enlarged base defining the overall size and shape of the panel member,
2. a substantially continuous upstanding wall peripherally surrounding the base and extending therefrom, dimensioned for peripherally surrounding a major portion of the pivotable product for providing cooperating secure retention thereof and defining a holding zone and a product securement zone, and
3. an extending lip surrounding the wall and extending outwardly therefrom, and b. a second panel member constructed for cooperating, aligned, spaced, juxtaposed association with the first panel member and constructed for interlocking engagement therewith to form the holding and display member with the product securely retained therein and incorporating;

1. an enlarged base defining the overall size and shape of the panel member,
2. a substantially continuous upstanding wall peripherally surrounding the base and extending therefrom, dimensioned for peripherally surrounding a major portion of the pivotable product for providing cooperating secure retention thereof and defining a holding zone and a product securement zone, and
3. an extending lip surrounding the wall and extending outwardly therefrom, and B. a portal zone forming the wall member of the housing and positioned for enabling the control portion of the first arm member of the product to extend outwardly from the housing and be freely movable relative thereto;

C. a product securement zone of the housing comprising a. a substantially continuous upstanding flange formed on the base of the first panel member within the area defined by the upstanding wall thereof and dimensioned for cooperating, secure, retaining engagement within the finger receiving loop of the control portion of the second member; and b. a substantially continuous upstanding flange 1. formed on the base of the second panel member within the area defined by the upstanding wall thereof, and
2. constructed for cooperating, associated, peripherally surrounding, nested engagement with the flange of the first panel member for assuring complete, peripheral surrounding, secure retained engagement of the finger receiving loop of the second member;

D. a holding zone formed in the housing for peripherally surrounding and enclosing the operating portions of the first and second arm members, enabling the operating portion of at least the first arm member to be arcuately pivoted into and out of cooperating engagement with the operating portion of the second arm member; and E. position securing means formed in the housing in cooperating association with the upstanding, nested, interengaged flanges of the first and second panels for assuring secure, interlocked, retention of the product in the housing, and comprising a. an upstanding boss formed in the first panel member, and b. an upstanding post formed in the second panel member and positioned for cooperating aligned engagement with the boss of the first member whereby a holding and displaying member is attained which enables the product to be tested prior to use, while assuring secure, retained, interengagement of the product within the holding and display member.

16. The holding and displaying member defined in claim 15, wherein said post of the position securing means is further defined as comprising a protrusion extending therefrom and said boss of the position securing means is further defined as comprising a cavity constructed for cooperating, receiving, locking engagement of the protrusion, thereby assuring secure engagement therebetween.

17. The holding and displaying member defined in claim 15, wherein the first panel member and the second panel member are further defined as being integrally attached to each other along opposed sides by an integrally formed elongated hinge member to enable the second panel member to be pivoted about the hinge member from a first position substantially adjacent to the first panel member to a second position in overlying, aligned, juxtaposed engagement with the first panel member, and the upstanding flanges of the first and second panel members are dimensioned to achieve arcuate, pivoting nested engagement of the flange of the second panel members with the flange of the first panel member and the second panel member is moved from its first position to its second position.

18. The holding and displaying member defined in claim 17, wherein the portal zone is further defined as being elongated to enable the control portion of the first arm member to contact the control portion of the second arm member when the product is in its closed position.

19. The holding and displaying member defined in claim 15, wherein the extending lip of the first panel member and the extending lip of the second panel member are further defined as being constructed for overlying, contacting, securely affixed engagement with each other when the second panel member is in its second position.

* * * * *